United States Patent [19]

Korzon

[11] 4,270,463

[45] Jun. 2, 1981

[54] DISPLAY STAND WITH EASILY ADJUSTED SHELVES

[75] Inventor: Edward S. Korzon, Beacon Falls, Conn.

[73] Assignee: Dura Plastics of New York, Inc., Bridgeport, Conn.

[21] Appl. No.: 58,614

[22] Filed: Jul. 18, 1979

[51] Int. Cl.[3] ..... A47B 57/06

[52] U.S. Cl. ..... 108/96; 108/144

[58] Field of Search ..... 108/96, 92, 108, 144, 108/151, 106; 248/246, 218.4, 158, 188.91; 211/193, 107, 208, 209

[56] References Cited

U.S. PATENT DOCUMENTS

| | | | |
|---|---|---|---|
| D. 189,510 | 12/1960 | Tissot | 211/208 X |
| 650,700 | 5/1900 | Willner | 108/96 |
| 728,598 | 5/1903 | McFatrich | 108/144 X |
| 2,649,972 | 8/1953 | Weil | 108/108 X |
| 2,666,478 | 1/1954 | Shwayder | 248/188.91 X |
| 2,935,205 | 5/1960 | Higgin . | |
| 3,104,625 | 9/1963 | Conley | 108/96 |
| 3,167,292 | 1/1965 | Meyerowitz | 211/107 X |
| 3,245,365 | 4/1966 | Doherty | 108/144 |
| 3,458,234 | 7/1969 | Bates | 248/230 |
| 3,709,166 | 1/1973 | Bush | 108/144 X |

FOREIGN PATENT DOCUMENTS

| | | | |
|---|---|---|---|
| 915635 | 11/1972 | Canada | 211/193 |

*Primary Examiner*—Francis K. Zugel

*Attorney, Agent, or Firm*—Birch, Stewart, Kolasch & Birch

[57] ABSTRACT

A knock-down ladder shaped plant stand is provided with a fixed top step and adjustable side steps or shelves down each side in a double step ladder configuration. The shelves are all mounted on inverted V-shaped standards with the top step on the apices of the standards and the shelves slidably mounted on the legs thereof. Rubber or elastomeric grommets are provided to define stops on the legs where the steps or shelves are positioned.

2 Claims, 4 Drawing Figures

DISPLAY STAND WITH EASILY ADJUSTED SHELVES

FIELD OF THE INVENTION

This invention relates to a display stand for displaying living plants, flowers, decorative articles, and the like.

BACKGROUND OF THE INVENTION

Ladder shaped display stands for plants, artifacts and the like are a desirable and popular configuration.

It is an object of the present invention to provide a new and novel ladder shaped display stand having an infinite variation in the positions of its shelves or steps to accommodate various size plants and artifacts.

Another object of the present invention is to provide a new and novel ladder shaped display stand which has a unique and substantially infinite position adjusting means for the shelves or steps thereof; may be shipped in knocked down condition; and which may be readily assembled at its point of use.

These and other objects of the present invention will become more fully apparent with reference to the following specification and drawings which relate to a preferred embodiment of the invention.

SUMMARY OF THE INVENTION

The present invention is a display stand that may be shipped from the manufacturer in disassembled condition and may be easily assembled by the most skilled purchaser. The assembled stand of this invention is shaped somewhat like a ladder and is sturdy and attractive in appearance. Its shelves are readily adjustable in height and are capable of bearing a substantial load. The shelves are slidably mounted on at least vertical standards extending through respective ports in each shelf. These standards are surrounded by vertically adjustable rubber or elastomeric rings or grommets which cause the shelves to bind on the vertical standards just above and in juxtaposition with the said grommets. Two such standards extend down each side of the ladder structure from a fixed top step.

BRIEF DESCRIPTION OF THE DRAWINGS

The invention will be described by referring to the accompanying drawings wherein.

DETAILED DESCRIPTION OF THE DRAWINGS

Referring in detail to the drawings, the frame of the stand is comprised of two inverted, generally V-shaped, or U-shaped, frame members 11 and 12. The legs 11A and 11B of frame member 11 are inclined toward each other and are joined to an integral horizontal portion 11C. Frame member 12 is identically formed and includes inclined legs 12A and 12B and integral horizontal portion 12C. Frame members 11 and 12 preferably are fashioned from solid circular rods of synthetic plastic material such as clear acrylic plastic. Alternatively, they may be fashioned from aluminum or stainless steel tubular goods. The unitary lengths of solid circular plastic stock or tubular goods may be bent to the desired shape by methods well known to those skilled in the art.

Figure 1:
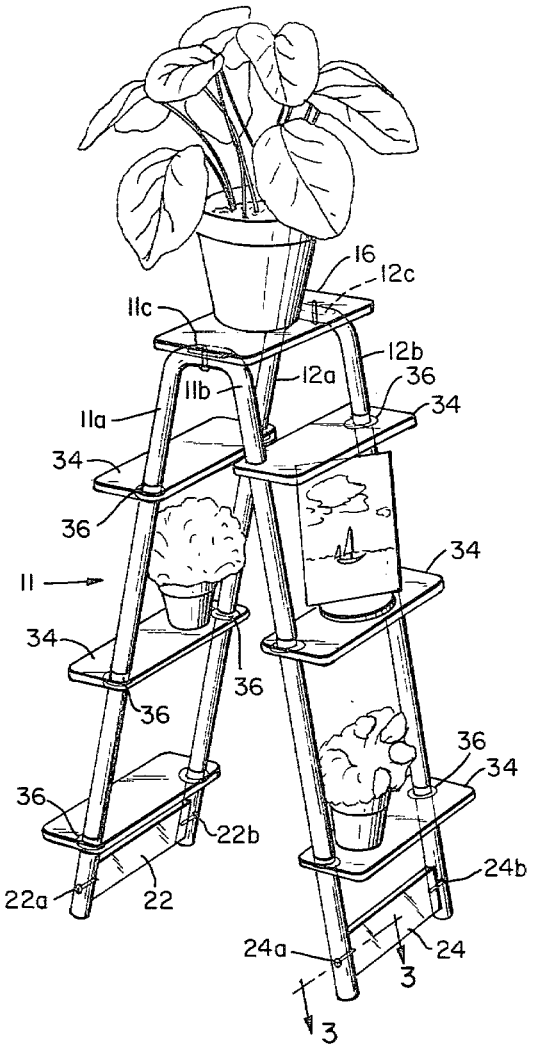
FIG. 1 is a perspective view showing the assembled stand of this invention as it might typically be used.
Figure 2:
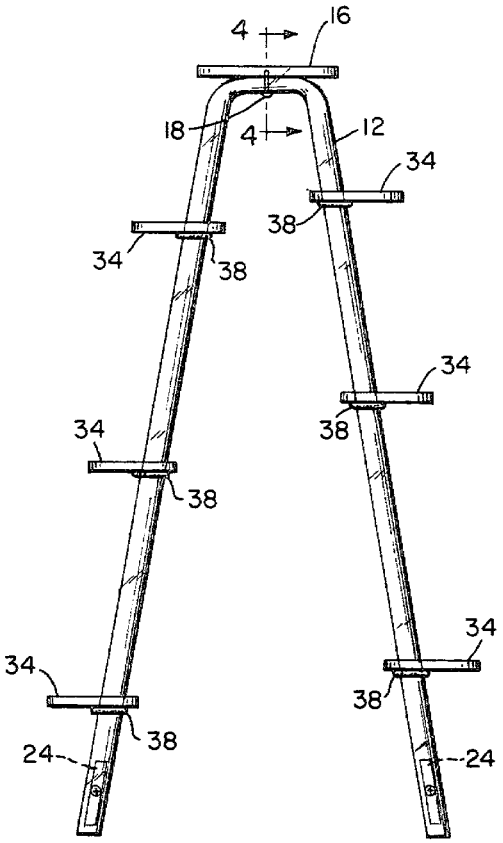
FIG. 2 is a side view of the assembled stand.
Figure 4:
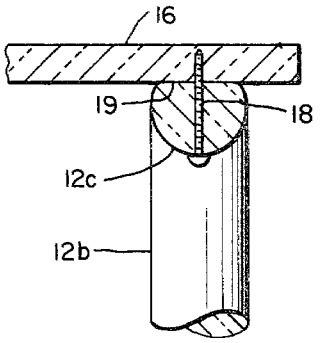
FIG. 4 is a partial sectional view taken at section 4—4 of FIG. 2 showing how the top platform is secured to the legs of the stand.

As seen in FIGS. 1, 2 and 4, a rigid, load bearing top platform 16 extends horizontally between and beyond the horizontal portions 11C and 12C of the frame members 11 and 12. As best seen in FIG. 4, screws 18 pass upwardly through the horizontal portions 11C and 12C and secure the rigid top platform 16 to frame members 11 and 12. As thus positioned, screws 18 are substantially out of view and do not interfere with the smooth and flat top surface of platform 16.

The top surfaces 19 of the integral horizontal portions 11C and 12C of frame members 11 and 12, see FIG. 4, are flat and horizontal so that they conform to the flat horizontal underside of platform 16. These mutually compensating mating surfaces of platform 16 and frame portions 11C and 12C make for a firm fit therebetween. These flat contacting surface areas contribute to the rigidity of the frame to a much greater extend than would be achieved if the platform 16 and horizontal portions 11C and 12C made contact along a line, which would be the case if the flat portions 19 were not provided.

Figure 3:
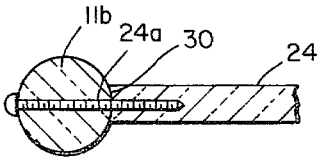
FIG. 3 is a sectional view taken at section 3—3 of FIG. 1 showing how a bottom bracing member is secured to the legs of the stand.

The bottom ends of legs 11A and 12A are secured to a rigid bracing member 22 by means of screws 22A and 22B. Similarly, the bottom ends of legs 11B and 12B are secured to rigid bracing member 24 by screws 24A and 24B. As seen in FIG. 3, the end edge of bracing member 24 is contoured to conform to the circular shape of leg 11B. All end edges of bracing members 22 and 24 have the same contour that is mutually complementing with the surfaces of frame members 11 and 12 so that the braces make a good and firm fit to the legs and will not twist away from the positions illustrated. That is, braces 22 and 24 are in contact with the legs completely throughout the lengths of their contoured end edges 30. This feature of the mutually complementing surface on the end edges of the braces adds significantly to the rigidity of the stand.

As seen in FIGS. 1 and 2, a plurality of rigid, load bearing shelves 34 extend between each pair of legs 11A, 12A and 11B, 12B and give the stand somewhat the appearance of a ladder. All shelves are identical and each has a pair of circular apertures 36 adjacent its back corners. Apertures 36 are sufficiently large to permit the rigid shelves 34 to slide onto the circular legs of frame members 11 and 12. Shelves 34 may be made of any rigid, load supporting material. As presently preferred, they are made of the same clear acrylic plastic material as frame members 11 and 12.

Shelf supporting means such as tight fitting grommets, eyelets, or washers 38 are positioned on the legs of frame members 11 and 12 under each aperture in a shelf 34. Grommets 38 desirably are made of rubber or some other elastomeric material and have an outer radius greater than the radii of the apertures 36 in shelves 34. Consequently, grommets 38 support shelves 34 in load supporting position. Grommets 38 fit sufficiently tightly on the legs of the frame members 11 and 12 to remain fixed in position on the legs under the greatest load anticipated to be placed on a shelf. Yet, the grommets are not so tight as to prevent them from being slid or otherwise moved along the legs of frame members 11 and 12 to permit the positions of shelves 34 to be adjusted in height. In this manner the stand may accommodate plants and articles of various sizes.

The thickness of shelves 34, at least in the areas around apertures 36 where the shelves contact the legs of the stand, is sufficiently great to support the shelves in substantially a horizontal position and to assure that the shelves will not rotate and tip downwardly when a load is placed on them. As illustrated in the drawings, because the apertures 36 are toward the rear of the shelves, the shelves are cantilevered from the legs. Desirably, the clearance between the apertures 36 and the legs 11A, 11B, 12A, 12B is no greater than necessary to permit the shelves to slide on the legs. With this relationship, and with the legs being inclined toward each other, the edges of the apertures on the shelves will tend to bind or jam on the legs when a load is placed on the shelves. This binding effect prevents the shelves from rotating and supports the loaded shelf in a substantially horizontal position. The binding or jamming effect also helps support the load and relieves some of the vertical force from the grommets 38. Of course, shelves 34 are sufficiently thick to give them the rigidity and required strength to support the weight of anticipated loads.

A stand is packaged by the manufacturer in completely disassembled condition. A purchaser may easily assemble the stand by first placing frame members 11 and 12 parallel and adjacent each other. Platform 16 is placed in its desired position on the flat areas 19 on top of the horizontal portions 11C and 12C of the frame members. Screws 18, FIG. 4, are passed through horizontal portions 11C and 12C and into the bottom of platform 16. The platform then is secured to the two frame members 11 and 12. Next, frame members 11 and 12 may be turned upside down and a shelf is slid over each pair of legs 11A, 12A and 11B, 12B to the positions desired for top shelves on each side of the stand. An elastomeric grommet 38 is slid over each leg and brought into supporting contact with the bottom surface of its corresponding shelf so that the two top shelves will be supported at their desired positions on the legs when the stand is turned upright. The remainder of the shelves 34 and grommets 38 are positioned on legs 11A, 12A and 11B, 12B in the same manner so that all six shelves 34 will be supported in their desired positions by grommets 38. Lastly, the supporting braces 22 and 24 are positioned in their illustrated positions between the bottom ends of respective pairs of legs 11A, 12A and 11B, 12B and are secured there by suitable means such as the illustrated screws of FIG. 3.

Other assembly sequences may be followed, if desired.

If any final adjustment in the position of any shelf is required, the respective grommets 38 are slid along their legs to the new positions. The shelf then is repositioned in contact with the moved grommets.

From the above description it is seen that a stand having the unitary, inverted U-shaped legs with slidable shelves and adjustable shelf supporting means is relatively simple to manufacture and is easy to assemble. The use of bracing members, including top platform 16, that have contacting surfaces that are mutually complementary in shape to the surfaces of the frame members adds to the strength and rigidity of the stand.

As stated, elastomeric grommets presently are preferred for the shelf supporting means. There are various types of spring clip washers that could serve the same purpose. However, many of them are made of metal and possibly would mar the surfaces of the frame members 11 and 12 when they are slid into position, and when they are repositioned.

It is claimed:

1. A display stand for displaying flowers, plants, articles and the like, comprising:

first and second frame members each made of an elongated, round, rigid member that is bent at its center region to form two upwardly extending legs with an integral horizontal portion therebetween;

the legs of each frame member being inclined toward each other with the top portions closer together than the bottom portions, said horizontal portions having flat contact surface areas;

said frame members being positioned parallel to each other with corresponding legs of the two members spaced from each other;

rigid bracing means secured between each pair of corresponding parallel legs of said first and second frame members at or near the bottom of said legs;

a rigid, load supporting platform having a flat horizontal underside secured to the horizontal portion of said frame members;

a plurality of rigid, load supporting shelf members extending between corresponding and parallel legs of said two frame members, whereby said stand has the appearance of a ladder;

each shelf member having first and second round apertures extending through an edge region thereof, each aperture receiving a respective leg of a frame member in a sliding engagement, thereby to permit a shelf to be slid along a pair of legs of the frame;

a pair of elastomeric grommets tightly fitting on the respective legs of the frame members under each shelf for supporting said shelf in a cantilevered, load bearing manner between a respective pair of legs; and said shelves having a sufficient thickness and said apertures having sufficient radii to cause edges around said apertures to engage said legs in a manner to prevent said shelves from rotating from their desired horizontal positions when a load is placed on the shelves.

2. The stand claimed in claim 1, wherein said frame members and said shelves are made of a clear synthetic plastic material.

* * * * *